US010943537B2

(12) United States Patent
Li et al.

(10) Patent No.: US 10,943,537 B2
(45) Date of Patent: Mar. 9, 2021

(54) PIXEL CIRCUIT CONFIGURED TO DRIVE LIGHT-EMITTING ELEMENT AND DRIVING METHOD THEREFOR, AND DISPLAY SUBSTRATE

(71) Applicants: BOE TECHNOLOGY GROUP CO., LTD., Beijing (CN); Beihang University, Beijing (CN)

(72) Inventors: Hongge Li, Beijing (CN); Yuliang Li, Beijing (CN); Jiangnan Lu, Beijing (CN)

(73) Assignees: BOE TECHNOLOGY GROUP CO., LTD., Beijing (CN); BEIHANG UNIVERSITY, Beijing (CN)

( * ) Notice: Subject to any disclaimer, the term of this patent is extended or adjusted under 35 U.S.C. 154(b) by 0 days.

(21) Appl. No.: 16/619,224

(22) PCT Filed: Dec. 3, 2018

(86) PCT No.: PCT/CN2018/118980

§ 371 (c)(1),
(2) Date: Dec. 4, 2019

(87) PCT Pub. No.: WO2019/120069

PCT Pub. Date: Jun. 27, 2019

(65) Prior Publication Data

US 2020/0152124 A1 May 14, 2020

(30) Foreign Application Priority Data

Dec. 20, 2017 (CN) ..... 201711385569.4

(51) Int. Cl.
*G09G 3/3233* (2016.01)

(52) U.S. Cl.
CPC ... *G09G 3/3233* (2013.01); *G09G 2300/0842* (2013.01)

(58) Field of Classification Search
CPC ..... G09G 3/3225; G09G 3/3233; G09G 2300/0814; G09G 2300/0819;
(Continued)

(56) References Cited

U.S. PATENT DOCUMENTS 8,692,743 B2 4/2014 Tsai et al.
10,210,805 B2 2/2019 Nagayama et al.
(Continued)

FOREIGN PATENT DOCUMENTS

CN 101609840 A 12/2009
CN 101714574 A 5/2010
(Continued)

OTHER PUBLICATIONS

Linglong Zhang; The Rsearch on Organic Thin-Film transistor Fabrication and Device Model, China Excellent Master Thesis Full-text Database Information Technology Series Jan. 31, 2015.
(Continued)

*Primary Examiner* — Nelson M Rosario

(57) ABSTRACT

A pixel circuit configured to drive a light-emitting element and a driving method therefor, and a display substrate, the pixel circuit comprising: a first switch sub-circuit configured to input, under the control of a first control signal line, a data signal of a data signal line to a first node; a second switch sub-circuit configured to input, under the control of a second control signal line, a first signal of a first signal line to a second node; a driving sub-circuit configured to drive, under the control of the potential of the first node, the light-emitting element to emit light; and a memory sub-circuit configured to store a threshold voltage of the driving sub-circuit before the second switch sub-circuit is turned on in each work cycle of the pixel circuit.

14 Claims, 10 Drawing Sheets

(58) Field of Classification Search
CPC ... G09G 2300/0842; G09G 2300/0861; G09G 2310/0251; G09G 2320/0233; G09G 2320/0257; G09G 2320/043; G09G 2320/045
See application file for complete search history.

(56) References Cited

U.S. PATENT DOCUMENTS

| | | | | |
|---|---|---|---|---|
| 10,347,184 | B2 | 7/2019 | Han et al. | |
| 10,431,142 | B2 * | 10/2019 | Cheng | G09G 3/2092 |
| 2005/0105031 | A1 | 5/2005 | Shih et al. | |
| 2009/0309503 | A1 * | 12/2009 | Kim | G09G 3/3233 315/169.3 |
| 2015/0379934 | A1 | 12/2015 | Xiaoling | |
| 2016/0189627 | A1 | 6/2016 | Park et al. | |
| 2017/0301296 | A1 | 10/2017 | Pappas et al. | |

FOREIGN PATENT DOCUMENTS

| | | | |
|---|---|---|---|
| CN | 1996637 | B | 11/2010 |
| CN | 101986378 | A | 3/2011 |
| CN | 102082181 | B | 1/2013 |
| CN | 103680406 | A | 3/2014 |
| CN | 103762251 | A | 4/2014 |
| CN | 103903556 | A | 7/2014 |
| CN | 103943067 | A | 7/2014 |
| CN | 104658481 | A | 5/2015 |
| CN | 104751777 | A | 7/2015 |
| CN | 104751799 | A | 7/2015 |
| CN | 104778925 | A | 7/2015 |
| CN | 104867441 | A | 8/2015 |
| CN | 104933993 | A | 9/2015 |
| CN | 105096819 | A | 11/2015 |
| CN | 105632404 | A | 6/2016 |
| CN | 105808854 | A | 7/2016 |
| CN | 106782325 | A | 5/2017 |
| CN | 107170413 | A | 9/2017 |
| CN | 107393475 | A | 11/2017 |
| CN | 108062932 | A | 5/2018 |
| TW | 201218165 | A | 5/2012 |

OTHER PUBLICATIONS

The First Chinese Office Action dated Apr. 17, 2019; Appln. No. 201711385569.4.
International Search Report Application No. PCT/CN2018/097983; dated Sep. 30, 2018.
USPTO NFOA dated Nov. 17, 2020 in connection with U.S. Appl. No. 16/337,227.

* cited by examiner

PIXEL CIRCUIT CONFIGURED TO DRIVE LIGHT-EMITTING ELEMENT AND DRIVING METHOD THEREFOR, AND DISPLAY SUBSTRATE

CROSS-REFERENCE TO RELATED APPLICATIONS

The present application claims the priority right of Chinese patent application with the application No. of 201711385569.4, filed on Dec. 20, 2017 in China, which is incorporated by reference herein in its entirety as part of the present application.

TECHNICAL FIELD

The present disclosure relates to a pixel circuit constructed of an organic thin film transistor and a method for driving the pixel circuit.

BACKGROUND

Organic semiconductor devices have the advantages of flexibility, transparency, low cost, and large-area manufacturing, and have broad application prospects. After several years of development, the theory of organic semiconductor devices has gradually matured and the performance of devices has been continuously improved. Low-end application products such as flexible, transparent, printable RF electronic tags have begun to appear in foreign countries. Organic semiconductor-based thin film transistors are common components in flexible, transparent electronic circuits. As the performance of organic semiconductor-based thin film transistors continues to increase, the mobility of organic semiconductor-based thin film transistors can reach 0.1 to 10 $cm^2/Vs$, and the operating voltage can be decreased to about 5V.

However, the threshold voltage of a transistor may be unstable during operation, which may cause the current outputted by the transistor unstable, thereby affecting working effect of a transistor circuit.

SUMMARY

To this end, the present disclosure provides a method of determining electrical characteristics of a transistor at room temperature and operating temperature, and provides a pixel circuit that can store the threshold voltage of a transistor and a method of driving the same.

According to an aspect of the present disclosure, there is provided a pixel circuit configured to drive a light emitting element, comprising: a first switching sub-circuit, in which a first terminal of the first switching sub-circuit is connected to a data signal line, a second terminal of the first switching sub-circuit is connected to a first control signal line, and a third terminal of the first switching sub-circuit is connected to a first node, the first switching sub-circuit is configured to input a data signal of the data signal line to the first node under control of the first control signal line; a second switching sub-circuit, in which a first terminal of the second switching sub-circuit is connected to a first signal line, a second terminal of the second switching sub-circuit is connected to a second control signal line, and a third terminal of the second switching sub-circuit is connected to a second node, the second switching sub-circuit is configured to input a first signal of the first signal line to the second node under control of the second control signal line; a driving sub-circuit, in which a first terminal of the driving sub-circuit is connected to the first node, a second terminal of the driving sub-circuit is connected to the second node, and a third terminal of the driving sub-circuit is connected to an input terminal of the light emitting element, the driving sub-circuit is configured to drive the light emitting element to emit light under control of a potential at the first node; and a storage sub-circuit, in which a first terminal of the storage sub-circuit is connected to the first node, and a second terminal of the storage sub-circuit is connected to the second node, the storage sub-circuit is configured to store a threshold voltage of the driving sub-circuit before the second switching sub-circuit is turned on in each working period of the pixel circuit.

In an embodiment, the storage sub-circuit further comprises: a first capacitor, in which a first terminal of the first capacitor is connected to the first node, and a second terminal of the first capacitor is connected to the second node, the first capacitor is configured to store the threshold voltage of the driving sub-circuit before the second switching sub-circuit is turned on in said each working period.

In an embodiment, the storage sub-circuit further comprises: a second capacitor, in which a first terminal of the second capacitor is connected to the second node, and a second terminal of the second capacitor is connected to a second signal line.

In an embodiment, the driving sub-circuit comprises a driving transistor, a first terminal of the driving transistor is connected to the second node, a second terminal of the driving transistor is connected to the input terminal of the light emitting element, and a control terminal of the driving transistor is connected to the first node, the driving transistor is configured to be turned on under control of the potential at the first node, and drive the light emitting element to emit light.

In an embodiment, when the driving transistor is configured to be turned on under control of the potential at the first node, a driving current outputted by the driving transistor is determined through the following equation:

$$I_{OLED} = \frac{W}{L}\mu(T)C_{ox}V_{ds}\left[\frac{2k_BT}{q} + V_{gs} + V_{fb} + \frac{1}{2}V_{ds}\right]$$

where W is the channel width of the driving transistor, L is the channel length of the driving transistor, μ(T) is the carrier mobility of the driving transistor, $k_B$ is a Boltzmann constant, q is the electric quantity of a unit charge, T is the operating temperature of the driving transistor, $C_{ox}$ is the capacitance per unit area of insulating layer of the transistor, and $V_{fb}$ is the threshold voltage of the driving transistor, and $$V_{gs} = -\left(\frac{C_2}{C_1 + C_2}(V_{ref} - V_{data}) + |V_{fb}|\right)$$

where $V_{ref}$ is the reference voltage, $C_1$ is the capacitance value of the first capacitor, $C_2$ is the capacitance value of the second capacitor, and $V_{data}$ is the data voltage required for the driving transistor to operate.

In an embodiment, the first switching sub-circuit comprises a first switching transistor, a first terminal of the first switching transistor is connected to the data signal line, a second terminal of the first switching transistor is connected to the first node, and a control terminal of the first switching transistor is connected to the first control signal line, the first switching transistor is configured to be turned on under control of the first control signal line, and input the data signal of the data signal line to the first node.

In an embodiment, the second switching sub-circuit comprises a second switching transistor, a first terminal of the second switching transistor is connected to the first signal line, a second terminal of the second switching transistor is connected to the second node, and a control terminal of the second switching transistor is connected to the second control signal line, the second switching transistor is configured to be turned on under control of the second control signal line, and to input the first signal of the first signal line to the second node.

In an embodiment, the driving transistor is an organic thin film transistor.

In an embodiment, the first switching transistor is an organic thin film transistor.

In an embodiment, the second switching transistor is an organic thin film transistor.

In an embodiment, the light emitting element is an organic light emitting diode.

According to another aspect of the present disclosure, there is provided a display substrate, comprising the pixel circuit described above.

According to another aspect of the present disclosure, there is provided an method for driving the pixel circuit described above, comprising: a compensating phase, in which the first switching circuit is turned on under control of the first control signal line, the second switching circuit is turned off under control of the second control signal, and the storage sub-circuit stores the threshold voltage of the driving circuit; a writing phase, in which the first switching circuit is turned on under control of the first control signal line, the second switching circuit is turned off under control of the second control signal, the data signal inputted by the data signal line is inputted to the first node via the turned-on first switching circuit, and the data voltage is stored to the first capacitor; and a light emitting phase, in which the first switching circuit is turned off under control of the first control signal line, the second switching circuit is turned on under control of the second control signal, and the driving current is outputted by the driving sub-circuit to the light emitting element under control of the potential at the first terminal of the first capacitor, thus causing the light emitting element to operate normally.

In an embodiment, the storage sub-circuit further comprises: the first capacitor, a first terminal of the first capacitor being connected to the first node and a second terminal of the first capacitor being connected to the second node, the first capacitor being configured to store the threshold voltage of the driving sub-circuit before the second switching sub-circuit is turned on in each working period of the pixel circuit; and the second capacitor, a first terminal of the second capacitor being connected to the second node and a second terminal of the second capacitor being connected to the second signal line, storing the threshold voltage of the driving sub-circuit by the storage sub-circuit further comprises: after the second switching circuit is turned off under control of the second control signal, discharging the first capacitor via the driving sub-circuit, and when a voltage difference between the first terminal and the second terminal of the first capacitor decreases to the threshold voltage of the driving sub-circuit, turning off the driving sub-circuit.

By adopting the pixel circuit and its driving method provided by the present disclosure, according to the relationship between the output current and the control voltage of a transistor based on the Gaussian disordered jump theory, the driving current of the driving transistor outputted to the light emitting element can be predicted by using a computer simulation approach before the integrated circuit is fabricated. The driving method of the pixel circuit described above can provide a driving current which is not affected by change of the threshold voltage of the driving transistor to the light emitting element.

BRIEF DESCRIPTION OF THE DRAWINGS

In order to more clearly illustrate the technical solutions of the embodiments of the present disclosure, the drawings necessary for illustration of the embodiments of the present disclosure will be introduced below briefly. The drawings described below are only some embodiments of the present disclosure, and it is possible for a person of ordinary skill in the art to obtain other drawings based on these drawings without paying creative efforts. The following drawings are focused on illustrating the gist of the present disclosure, and not schematically scaled by actual dimensions.

DETAILED DESCRIPTION OF THE EMBODIMENTS

Figure 1:
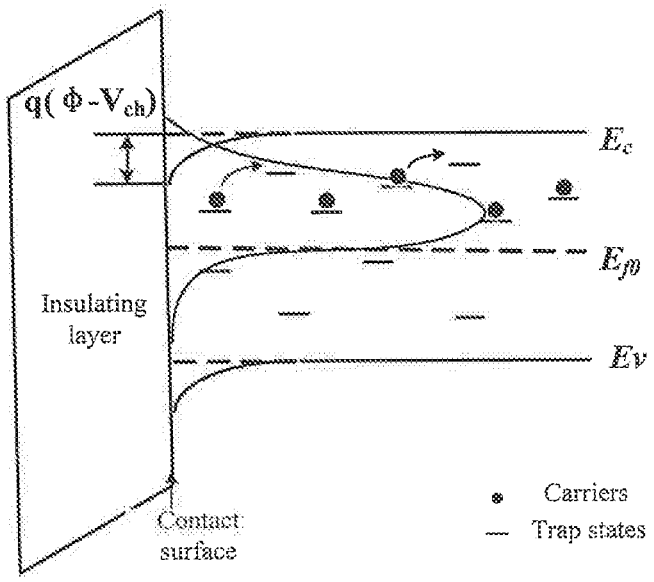
FIG. 1 shows an energy band structure at a contact surface between the insulating layer and the semiconductor material layer in the transistor.

Hereinafter, the technical solutions in the embodiments of the present disclosure will be described in a clear and complete way with reference to the accompanying drawings. Obviously, these described embodiments are merely parts of the embodiments of the present disclosure, rather than all of the embodiments thereof. Based on the embodiments of the present disclosure, all the other embodiments obtained by a person of ordinary skill in the art without paying creative effort are also within the protection scope of the present disclosure.

Words and expressions such as “first”, “second” and the like used in the present disclosure do not denote any sequence, quantity or priority, but distinguish different components. Likewise, words such as “include”, “comprise” and the like refer to that an element or an object before this word contains all the elements or objects listed thereinafter or alternatives thereof, without excluding other elements or objects. Words such as "connected", "connecting" and the like are not restricted to physical or mechanical connections, but may include electrical connections, regardless of direct or indirect connections. Words such as "up", "below", "left", "right", etc., are only used to denote relative positional relationship, once an absolute position of the described object changes, the relative positional relationship may probably change accordingly.

The transistor adopted in all of the embodiments of the present disclosure may be a thin film transistor, or a field effect transistor, or other devices of the same properties. In these embodiments, the source and the drain of each transistor may be interchanged in terms of connection manner, therefore, the drain and the source of each transistor in the embodiments of the present disclosure are actually indistinguishable. Herein, only to distinguish the two electrodes of the transistor except the gate, one electrode of the transistor is referred to as the source, and the other electrode thereof is referred to as the drain. The thin film transistor used in the embodiments of the present disclosure may be an N-type transistor or a P-type transistor. In the embodiments of the present disclosure, when the N-type thin film transistor is adopted, its first electrode may be the source and its second electrode may be the drain. In the following embodiments, as an example for illustration, the thin film transistor is the P-type transistor, that is, when the signal at the gate is at a high level, the thin film transistor is turned off. It is conceivable that when the N-type transistor is adopted, timing of the driving signal needs to be adjusted accordingly. The details are not described herein, but should also fall within the scope of the present disclosure.

A method for determining electrical characteristics of a transistor based on the Gaussian disorder jump theory according to the present disclosure is described below.

Under the condition that the operating temperature of the transistor is room temperature or a temperature above room temperature, field mobility of the carriers in channels of the transistor satisfies Equation (1):

$$\mu(T) = \mu_0 \times \exp\left[-E_a\left(\frac{1}{k_B T} - \frac{1}{k_B T_0}\right)\right] \tag{1}$$

where $\mu_0$ is a static carrier mobility, and $E_a$ is an activation energy.

In some embodiments, the activation energy may be determined by Equation (2):

$$E_a = \left[\frac{3}{40}C - \frac{1}{15}C\ln\left(\frac{n}{N}\right)\right]\sigma \tag{2}$$

where n represents the carrier concentration in channels of the transistor, N represents the total density of trap states within the energy gap, σ represents the energy disorder degree of semiconductor material of the semiconductor material layer in the transistor, and C is a parameter related to the local state radius of the material of the active layer of the transistor.

FIG. 1 shows an energy band structure at a contact surface between the insulating layer and the semiconductor material in the transistor. As shown in FIG. 1, the left side of the contact surface is the insulating layer, and the right side thereof is the semiconductor material layer. In the semiconductor material layer, the upper $E_c$ is a conduction band energy level, and the lower $E_v$ is a valence band energy level. The short horizontal lines between the conduction hand energy level $E_c$ and the valence band energy level $E_v$ are separate trap states, in which trap states near the middle are deep trap states and trap states near the conduction band or the valence band are shallow trap states. Under low temperature conditions, the deep trap states are gradually occupied as the temperature increases. When the temperature increases to the operating temperature of the transistor, the carriers mainly transfer charge in the form of jumping between the shallow trap states. In some embodiments, the Gaussian distribution can be used to simulate the distribution of trap states in the semiconductor material within a range of the operating temperature of the transistor. That is to say, under the operating temperature of the transistor, the Gaussian disorder jump theory can be used to determine the charge transfer in the semiconductor material. Based on the Gaussian disorder jump theory, the carrier concentration in channels of the transistor satisfies Equation (3):

$$n = \int_{-\infty}^{+\infty} \frac{N}{\sqrt{2\pi\sigma^2}} \exp\left(\frac{-E^2}{2\sigma^2}\right) f(E)dE \tag{3}$$

where n represents the carrier concentration in channels of the transistor, N represents the total density of trap states within the energy gap, f(E) represents the occupancy probability of the carriers at energy E, σ represents the energy disorder degree of semiconductor material of the semiconductor material layer in the transistor, and the higher the structure disorder degree of the semiconductor material is, the higher the value of σ is.

In some embodiments, the occupancy probability of the carriers at energy E can be approximated by the Fermi-Dirac distribution, then the carrier concentration in channels of the transistor satisfies Equation (4):

$$n = \int_{-\infty}^{+\infty} \frac{N}{\sqrt{2\pi\sigma^2}} \exp\left(\frac{-E^2}{2\sigma^2}\right) f(E)dE \approx n_0 \exp\left[\frac{q(\varphi - V_{ch})}{k_B T}\right] \tag{4}$$

where φ is the potential distribution along a direction perpendicular to the channel direction (i.e., the x direction), $V_{ch}$ is the potential distribution along the channel direction (i.e., the y direction), $k_B$ is a Boltzmann constant, and T is a temperature. In some examples, the value of T is 300K at the operating temperature of the transistor. When the operating temperature of the transistor changes, the value of the temperature T in Equation (4) can be changed to a corresponding operating temperature of the transistor.

The electric field $F_x$ (Equation (6)) in the x direction in channels can be determined according to the Poisson equation (Equation (5)):

$$\frac{d^2\varphi}{dx^2} = -\frac{dF_x}{dx} = -\frac{qn}{\varepsilon_s} \tag{5}$$

$$F_x(\varphi_x, V_{ch}) = \sqrt{\frac{2k_B T}{\varepsilon_s} n_a}\left[\exp\left(-\frac{qV_{ch}}{k_B T}\right)\left(\exp\left(\frac{q\varphi_x}{k_B T}\right) - 1\right)\right]^{1/2} \tag{6}$$

where $k_B$ is a Boltzmann constant, T is a temperature, $\varepsilon_s$ is the dielectric constant of the semiconductor material layer, q is the electric quantity of a unit charge, $\varphi_x$ is the potential distribution along a direction perpendicular to the channel direction, and $V_{ch}$ is the potential distribution along the channel direction.

According to Equation (6), the electric field distribution $F_s$ of the semiconductor-insulating layer contact surface in the transistor can be determined, as shown in Equation (7):

$$F_s = F(x=0) \tag{7}$$

Based on the Gauss theorem and the electric field distribution of the semiconductor-insulating layer contact surface in channels of the transistor, the charge distribution in channels of the transistor can be determined based on Equation (8):

$$Q_x = -\varepsilon_x F_s = -\sqrt{2k_B T \varepsilon_x n_s}\left[\exp\left(-\frac{qV_{ch}}{k_B T}\right)\left(\exp\left(\frac{q\varphi_x}{k_B T}\right)-1\right)\right]^{1/2} \tag{8}$$

According to the gradual channel approximation theory of transistors, when the gate voltage of the transistor is in a linear region and a saturation region, the current $I_{above}$ in channels of the transistor can be determined by Equation (9):

$$I_{above} = \frac{W}{L}\int_{V_c}^{V_d} \mu |Q_S| dV_{ch} \tag{9}$$

where W is the channel width, L is the channel length, $V_s$ is the source voltage, and $V_d$ is the drain voltage.

Based on Equations (1) to (9), the relationship of how the drain current $I_{above}$ of the transistor changes as a function of the gate voltage $V_g$ can be determined as:

$$I_{above} = \frac{W}{L}\int_{V_c}^{V_d} \mu |Q_s| dV_{ch} = \frac{W}{L}\mu(T)\left[-\frac{2k_B T}{q}(Q_{Sd}-Q_{Ss}) + \frac{1}{2C_{ox}}(Q_{Sd}^2 - Q_{Ss}^2)\right] \tag{10}$$

where W is the channel width, L is the channel length, $V_d$ is the drain voltage, and $V_s$ is the source voltage, $Q_{Ss}=-C_{ox}(V_g-V_{fb}-V_s)$、$Q_{Sd}=-C_{ox}(V_g-V_{fb}-V_d)$, $C_{ox}$ is the capacitance per unit area of insulating layer of the transistor, and $V_{fb}$ is the threshold voltage of the transistor.

The principle of the pixel circuit provided by the present disclosure will be explained herein with reference to the relationship between the output current and the control voltage of the transistor determined in the Equation (10).

The relationship between the output current and the control voltage of the transistor can be determined utilizing the aforementioned method. Through the relationship between the output current and the control voltage of the transistor, feasibility of a designed circuit can be verified utilizing a computer simulation approach before fabrication of the integrated circuit that adopts the transistor.

Figure 2A:
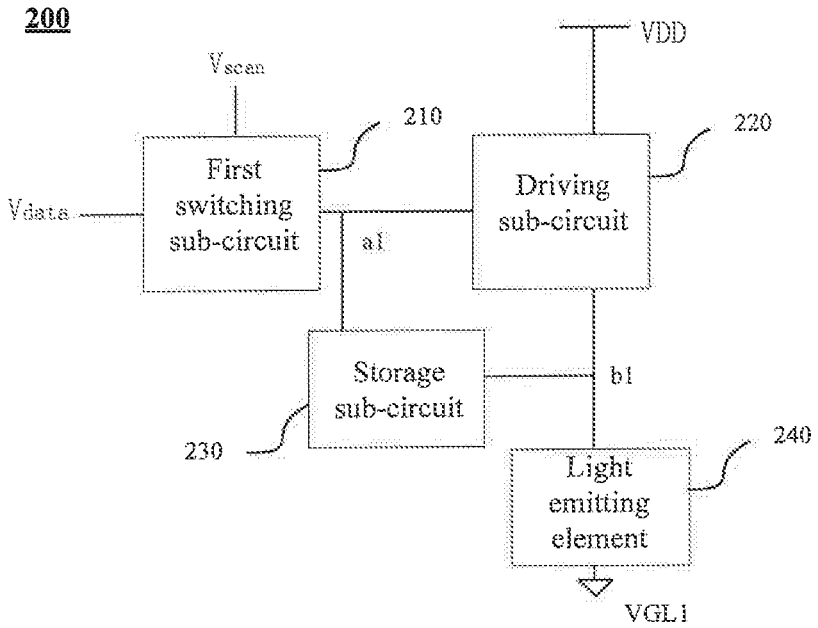
FIG. 2A shows a schematic block diagram of a pixel circuit according to an embodiment of the present disclosure.

FIG. 2A shows a schematic block diagram of a pixel circuit according to an embodiment of the present disclosure. The pixel circuit 200 comprises a first switching sub-circuit 210, a driving sub-circuit 220, a storage sub-circuit 230, and a light emitting element 240.

As shown in FIG. 2A, a first terminal of the first switching sub-circuit 210 is connected to a data signal line $V_{data}$, a second terminal of the first switching sub-circuit 210 is connected to a first control signal line $V_{scan}$, and a third terminal of the first switching sub-circuit 210 is connected to a first node a1. The first switching sub-circuit 210 is configured to input a data signal of the data signal line $V_{data}$ to the first node a1 under control of the first control signal line $V_{scan}$. A first terminal of the driving sub-circuit 220 is connected to a first signal line VDD, a second terminal of the driving sub-circuit 220 is connected to the first node a1, and a third terminal of the driving sub-circuit 220 is connected to a second node b1. The driving sub-circuit 220 is configured to output a driving current to the light emitting element under control of the first node a1. A first terminal of the storage sub-circuit 230 is connected to the first node a1, and a second terminal of the storage sub-circuit 230 is connected to the second node b1. The storage sub-circuit 230 is configured to store the data signal inputted by the data signal line $V_{data}$. A first terminal of the light emitting element 240 is connected to the second node b1, and a second terminal of the light emitting element 240 is connected to a second signal line VGL1. The first signal line VDD may input a high level signal, and the second signal line VGL1 may input a low level signal.

Figure 2B:
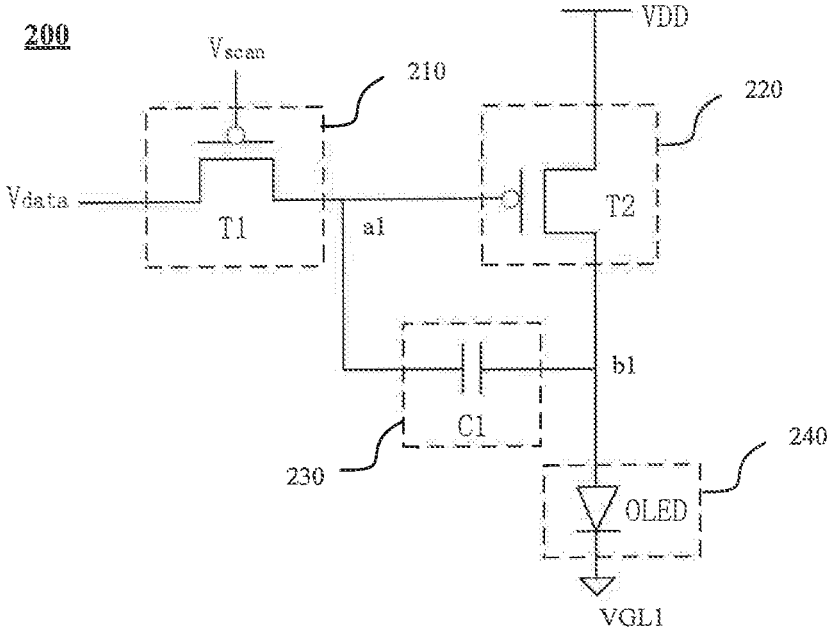
FIG. 2B shows a circuit structural diagram of a pixel circuit according to an embodiment of the present disclosure.

FIG. 2B shows a circuit structural diagram of a pixel circuit according to an embodiment of the present disclosure. The structure of the pixel circuit will be described in detail below with reference to FIGS. 2A and 2B.

As shown in FIG. 2B, in some embodiments, the first switching sub-circuit 210 may comprise a first switching transistor T1, a first terminal of the first switching transistor T1 is connected to the data signal line $V_{data}$, a second terminal of the first switching transistor T1 is connected to the first node a1, and a control terminal of the first switching transistor T1 is connected to the first control signal line $V_{scan}$. The first switching transistor T1 is configured to input a data signal inputted from the data signal line $V_{data}$ to the first node a1 under control of the first control signal line $V_{scan}$. The first switching transistor T1 may be an organic thin film transistor. As previously mentioned, when in the operating state, the first switching transistor T1 conforms to the Gaussian disorder jump theory as described above. The active layer of the organic thin film transistor is an organic material, and may specifically be pentacene, tetracene, pentathiophene, quaterphenyl, quinquephenyl, sexiphenyl or other deviants.

The driving sub-circuit 220 may comprise a driving transistor T2, a first terminal of the driving transistor T2 is connected to the first signal line VDD, a second terminal of the driving transistor T2 is connected to the first node a1, and a third terminal of the driving transistor T2 is connected to the second node b1. The first signal line VDD may input a high level signal. The driving transistor T2 is configured to output a driving current to the light emitting element under control of the first node a1. The driving transistor T2 may be an organic thin film transistor. When in the operating state, the driving transistor T2 conforms to the Gaussian disorder jump theory as described above.

The storage sub-circuit 230 may comprise a first capacitor C1, in which a first terminal of the first capacitor C1 is connected to the first node a1, and a second terminal of the first capacitor C1 is connected to the second node b1. The first capacitor C1 is configured to store the data signal inputted by the data signal line $V_{data}$.

The light emitting element 240 may be an organic light emitting diode OLED. A first terminal of the light emitting element 240 is connected to the second node b1, and a second terminal of the light emitting element 240 is connected to a second signal line. The second signal line may input a low level signal.

Figure 3:
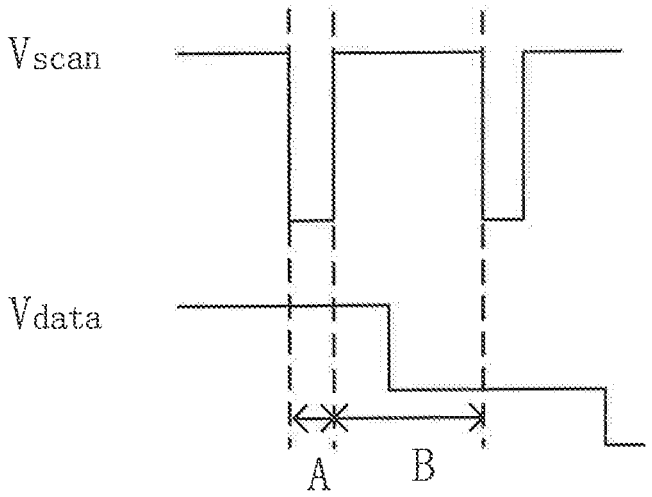
FIG. 3 shows a timing diagram of a pixel circuit according to an embodiment of the present disclosure.

FIG. 3 shows a timing diagram of a pixel circuit according to an embodiment of the present disclosure. The timing diagram shown in FIG. 3 can be used for the pixel circuit shown in FIGS. 2A and 2B.

According to the timing diagram shown in FIG. 3, at least a gating phase A and a maintaining phase B may be included in one working period of the pixel circuit. In the gating phase A, the first control signal line $V_{scan}$ may input a low level, the first switching transistor T1 is turned on under control of the first control signal. At this time, the signal $V_{data}$ inputted by the data signal line is inputted to the first node a1 via the first switching transistor T1, and the first capacitor C1 is charged.

During the maintaining phase B, the first control signal $V_{scan}$ may input a high level, the input signal of the data signal line $V_{data}$ is switched from a high level to a low level. At this time, the first switching transistor T1 is turned off under control of the high level. Because the first capacitor C1 is charged to the data voltage $V_{data}$ during the gating phase A, the voltage at the control terminal of the driving transistor is maintained as $V_{data}$ under control of the first capacitor C1.

At this time, the control terminal of the driving transistor T2 is controlled by the signal $V_{data}$ inputted from the data signal line. According to the method for determining the output current of the transistor as described above, by means of adopting Equation (10), after the gate voltage, the source voltage, and the drain voltage of the driving transistor are substituted into Equation (10), the output current of the driving transistor T2 can be determined by the following equation:

$$I_{OLED} = \frac{W}{L}\mu(T)C_{ox}V_{ds}\left[\frac{2k_BT}{q} - V_{data} + VDD + V_{fb} + \frac{1}{2}V_{ds}\right] \quad (11)$$

where $I_{OLED}$ is the driving current outputted by the driving transistor to the light emitting element (such as OLED), W is the channel width of the driving transistor, L is the channel length of the driving transistor, μ(T) is the carrier mobility of the driving transistor, $k_B$ is a Boltzmann constant, q is the electric quantity of a unit charge, T is the operating temperature of the driving transistor, $C_{ox}$ is the capacitance per unit area of insulating layer of the transistor, $V_{fb}$ is the threshold voltage of the driving transistor, $V_{data}$ is the data signal inputted by the data signal line, $V_{ds}$ is the voltage difference between the drain and the source of the driving transistor, and VDD is a high level signal inputted by the first signal line.

By means of the above pixel circuit and its timing sequence, the driving transistor T2 can output a stable driving current $I_{OLED}$ determined by Equation (11) to the light emitting element.

By means of adopting the above pixel circuit and its control timing, the relationship between the output current and the control voltage of the transistor based on the Gaussian disorder jump theory as described above can be utilized, a computer simulation approach can be used to predict the driving current outputted by the driving transistor to the light emitting element before the integrated circuit is fabricated, and a stable driving current can be outputted to the light emitting element.

Figure 4:
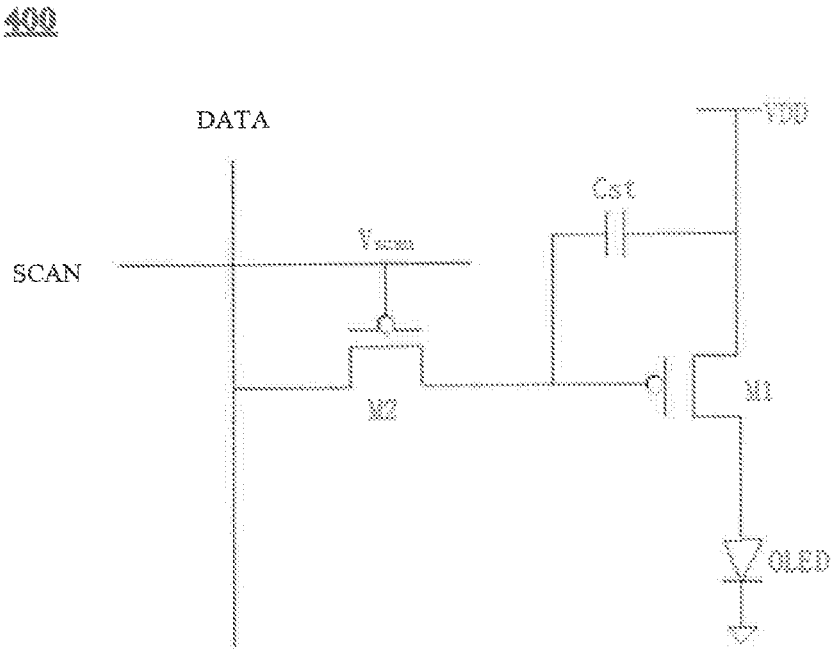
FIG. 4 shows a circuit structural diagram of a pixel circuit according to an embodiment of the present disclosure.

FIG. 4 shows a circuit structural diagram of another pixel circuit according to an embodiment of the present disclosure, in a currently often-used pixel circuit used for a display device, a capacitor is generally used to store the data signal for driving a transistor.

As shown in FIG. 4, the pixel circuit 400 comprises a driving transistor M1, a switching transistor M2, a storage capacitor Cst, and a light emitting element OLED. The switching transistor M2 is turned on or off under control of a control line SCAN. The signal inputted from a data line is transmitted to the storage capacitor Cst and the driving transistor M1 via the switching transistor M2. The driving current outputted from the driving transistor M1 is determined by the data signal inputted from the data line. The driving transistor M1 may be an organic thin film transistor. When in the operating state, the driving transistor M2 conforms to the Gaussian disorder jump theory as described above.

As previously mentioned, the driving current outputted by the driving transistor is related to the threshold voltage $V_{fb}$ of the driving transistor, if the threshold voltage $V_{fb}$, of the driving transistor changes during operation, luminance of the OLED changes along with $V_{fb}$.

Figure 5A:
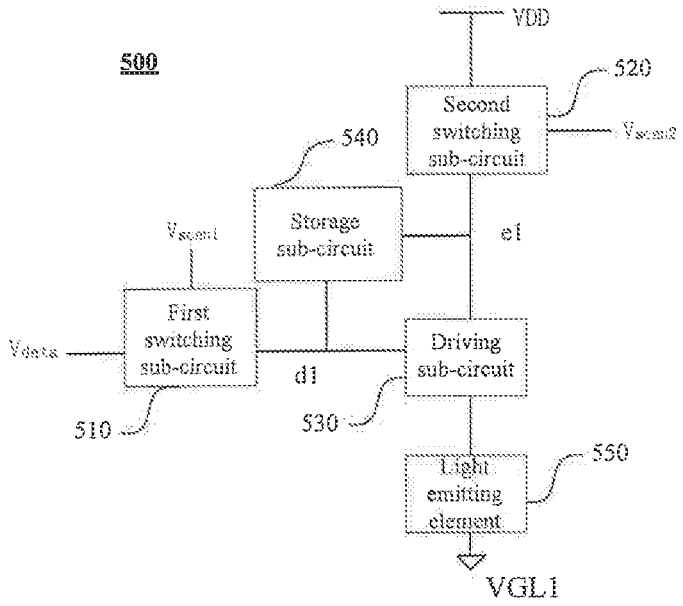
FIG. 5A shows a schematic block diagram of a pixel circuit according to an embodiment of the present disclosure.

FIG. 5A shows a schematic block diagram of another pixel circuit according to an embodiment of the present disclosure. The pixel circuit 500 comprises a first switching sub-circuit 510, a second switching sub-circuit 520, a driving sub-circuit 530, a storage sub-circuit 540 and a light emitting element 550.

As shown in FIG. 5A, a first terminal of the first switching sub-circuit 510 is connected to a data signal line $V_{data}$, a second terminal of the first switching sub-circuit 510 is connected to a first control signal line $V_{scan1}$, and a third terminal of the first switching sub-circuit 510 is connected to a first node d1. The first switching sub-circuit 510 is configured to input a data signal of the data signal line $V_{data}$ to the first node d1 under control of the first control signal line $V_{scan1}$.

A first terminal of the second switching sub-circuit 520 is connected to a first signal line VDD, a second terminal of the second switching sub-circuit 520 is connected to a second control signal line $V_{scan2}$, and a third terminal of the second switching sub-circuit 520 is connected to a second node e1. The second switching sub-circuit 520 is configured to input a first signal of the first signal line VDD to the second node e1 under control of the second control signal line $V_{scan2}$. The first signal line VDD may input a high level signal.

A first terminal of the driving sub-circuit 530 is connected to the first node d1, a second terminal of the driving sub-circuit 530 is connected to the second node e1, and a third terminal of the driving sub-circuit 530 is connected to an input terminal of the light emitting element 550. The driving sub-circuit 530 is configured to drive the light emitting element 550 to emit light under control of the potential at the first node d1.

A first terminal of the storage sub-circuit 540 is connected to the first node d1, and a second terminal of the storage sub-circuit 540 is connected to the second node e1. The storage sub-circuit 540 is configured to store the threshold voltage of the driving sub-circuit 530 before the second switching sub-circuit 520 is turned on in each working period of the pixel circuit.

The light emitting element 550 may comprise a light emitting diode LED, an organic light emitting diode OLED, or the like. A first terminal of the light emitting element 550 is connected to the second node e1, and a second terminal of the light emitting element 550 is connected to a second signal line. The second signal line may input a low level signal.

Figure 5B:
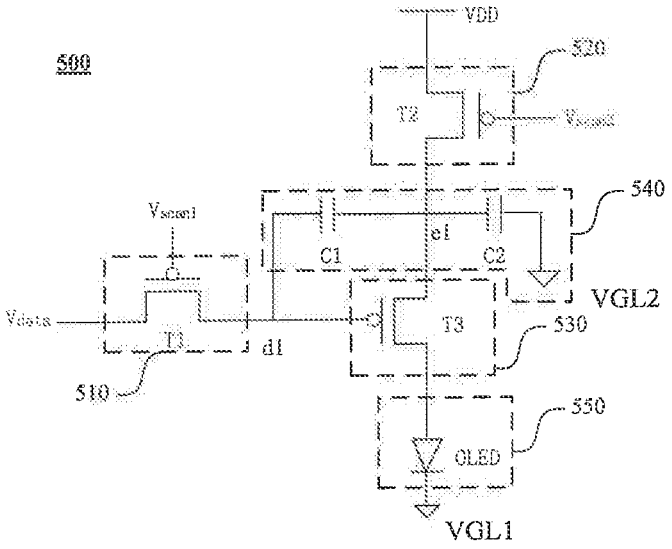
FIG. 5 shows a circuit structural diagram of a pixel circuit according to an embodiment of the present disclosure.

FIG. 5B shows a circuit structural diagram of another pixel circuit according to an embodiment of the present disclosure. The structure of the pixel circuit will be described in detail below with reference to FIGS. 5A and 5B.

As shown in FIG. 5B, in some embodiments, the first switching sub-circuit 510 may comprise a first switching transistor T1, a first terminal of the first switching transistor T1 is connected to the data signal line $V_{data}$, a second terminal of the first switching transistor T1 is connected to the first node d1, and a control terminal of the first switching transistor T1 is connected to the first control signal line $V_{scan1}$. The first switching transistor T1 may be an organic thin film transistor, and may also be an amorphous silicon transistor. When in the operating state, the first switching transistor T1 conforms to the Gaussian disorder jump theory as described above.

The second switching sub-circuit 520 may comprise a second switching transistor T2, a first terminal of the second switching transistor T2 is connected to the first signal line VDD, a second terminal of the second switching transistor 520 is connected to the second node e1, and a control terminal of the second switching transistor 520 is connected to the second control signal line $V_{scan2}$. The second switching transistor T2 may be an organic thin film transistor, and may also be an amorphous silicon transistor. When in the operating state, the second switching transistor T2 conforms to the Gaussian disorder jump theory as described above.

The storage sub-circuit 540 may comprise a first capacitor C1, a first terminal of the first capacitor C1 is connected to the first node d1, and a second terminal of the first capacitor C1 is connected to the second node e1. The first capacitor is configured to store the threshold voltage of the driving sub-circuit 530 before the second switching sub-circuit is turned on in each working period of the pixel circuit. The storage sub-circuit 540 may further comprise a second capacitor C2, a first terminal of the second capacitor C2 is connected to the second node e1, and a second terminal of the second capacitor C2 is connected to a third signal line VGL2. The third signal line VGL2 may input a low level signal. The capacitance values of the first capacitor C1 and the second capacitor C2 may be the same or different.

The light emitting element 550 may be an organic light emitting diode OLED. A first terminal of the light emitting element 550 is connected to the driving transistor T3, and a second terminal of the light emitting element 550 is connected to the second signal line VGL1. The second signal line VGL1 may input a low level signal.

Figure 6:
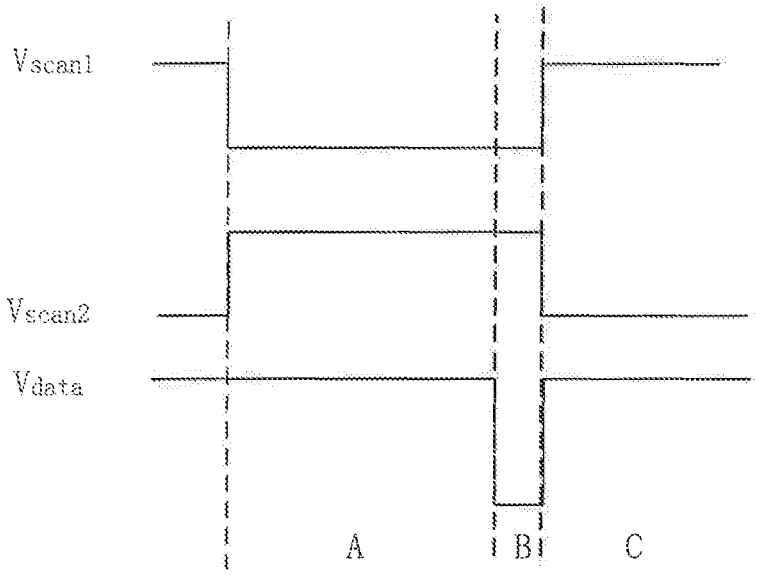
FIG. 6 shows a timing diagram of a pixel circuit according to an embodiment of the present disclosure.

FIG. 6 shows a timing diagram of a pixel circuit according to an embodiment of the present disclosure. The timing diagram shown in FIG. 6 can be used for the pixel circuit shown in FIGS. 5A and 5B.

Figure 7A:
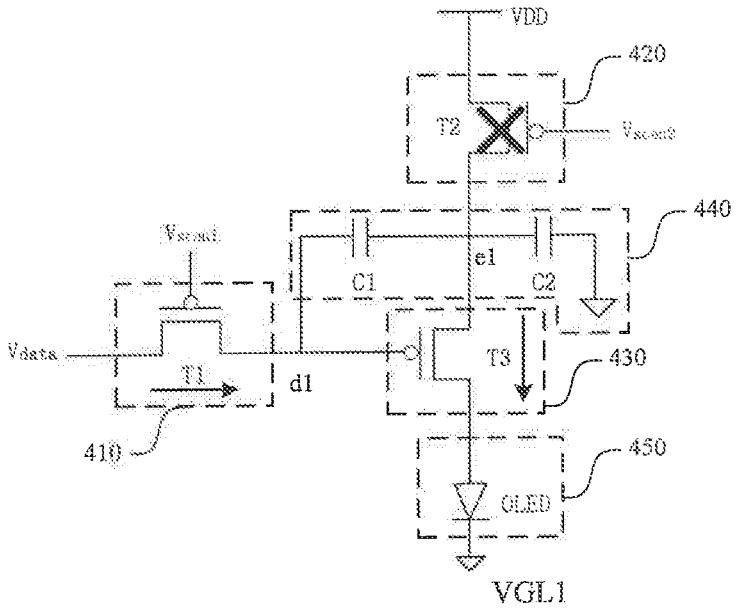
FIGS. 7A-7C show equivalent circuit diagrams of a pixel circuit according to an embodiment of the present disclosure.

FIG. 7A shows an equivalent circuit diagram of the pixel circuit 500 in the compensating phase A shown in FIG. 6. The first control signal line $V_{scan1}$ inputs a low level, and the second control signal line $V_{scan2}$ inputs a high level. The first switching transistor T1 is turned on under control of the first control signal with low level, and the second switching transistor T2 is turned off under control of the second control signal with high level. At this time, the data signal line $V_{data}$ inputs a reference voltage $V_{ref}$ with high level. It can be understood that before the compensating phase A, the second control signal line $V_{scan2}$ inputs a low level, at this time, the second switching transistor T2 is turned on under control of the low level signal. That is to say, the potential at the second node e1 at this time is the same as the high level inputted by the first signal line VDD. After the pixel circuit enters the compensating phase A, because the second switching transistor T2 is turned off, the potential at the second node e1 can no longer be maintained as VDD, discharging is performed via the driving transistor T3 until the voltage across two ends of the first capacitor C1 decreases to the threshold voltage of the driving transistor. When the voltage across two ends of the first capacitor C1 decreases to the threshold voltage of the driving transistor, the driving transistor T3 is turned off. That is, during the compensating phase A, the threshold voltage of the driving transistor T3 is stored in the first capacitor C1.

Figure 7B:
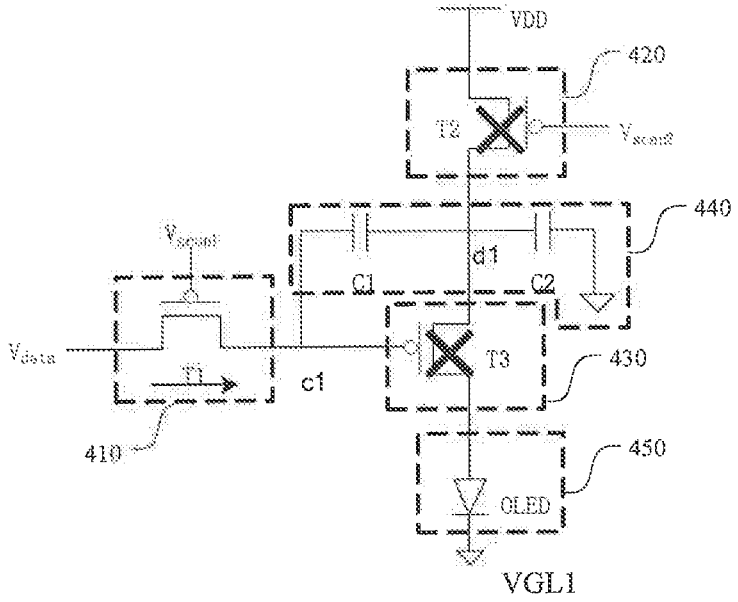

FIG. 7B shows an equivalent circuit diagram of the pixel circuit 500 during the writing phase B shown in FIG. 6. The first control signal line $V_{scan1}$ inputs a low level, and the second control signal line $V_{scan2}$ inputs a high level. The first switching transistor T1 is turned on under control of the first control signal with low level, and the second switching transistor T2 is turned off under control of the second control signal with high level. The signal inputted from the data signal line is decreased from the reference voltage $V_{ref}$ with high level to the data voltage $V_{data}$ with low level required for driving the transistor T3. At this time, because there is coupling effect between the first capacitor C1 and the second capacitor C2, and the threshold voltage previously stored in the first capacitor C1 in the compensating phase cannot be immediately released, the potential at the second node at this time is represented by the following equation:

$$V_{d1} = V_{ref} + |V_{fb}| + \frac{C_1}{C_1 + C_2}(V_{data} + V_{ref}) \tag{12}$$

Because the second switching transistor T2 maintains turned-off during the writing phase B, the light emitting element does not emit light during this phase.

Figure 7C:
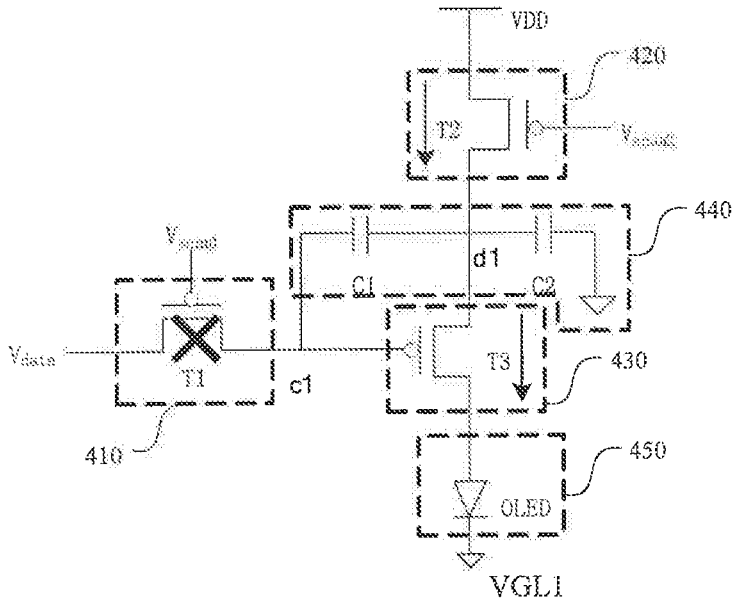

FIG. 7C shows an equivalent circuit diagram of the pixel circuit 500 during the light emitting phase C shown in FIG. 6. The first control signal line $V_{scan1}$ inputs a high level, and the second control signal line $V_{scan2}$ inputs a low level. The first switching transistor T1 is turned off under control of the first control signal with high level, and the second switching transistor T2 is turned on under control of the second control signal with low level. Using Equation (10), after the gate voltage, the source voltage, and the drain voltage of the driving transistor are substituted into Equation (10), the driving current supplied from the driving transistor T3 to the light emitting element can be determined by the following equation:

$$I_{OLED} = \frac{W}{L}\mu(T)C_{ox}V_{ds}\left[\frac{2k_BT}{q} + V_{gs} + V_{fb} + \frac{1}{2}V_{ds}\right] \tag{13}$$

where W is the channel width of the driving transistor, L is the channel length of the driving transistor, μ(T) is the carrier mobility of the driving transistor, $k_B$ is a Boltzmann constant, q is the electric quantity of a unit charge, T is the operating temperature of the driving transistor, $C_{ox}$ is the capacitance per unit area of insulating layer of the driving transistor, and $V_{fb}$ is the threshold voltage of the driving transistor; and using Equation (12), the gate-source voltage of the driving transistor T3 can be determined by the following equation:

$$V_{gs} = -\left(\frac{C_2}{C_1 + C_2}(V_{ref} - V_{data}) + |V_{fb}|\right) \quad (14)$$

where $V_{ref}$ is the reference voltage, $C_1$ is the capacitance value of the first capacitor, $C_2$ is the capacitance value of the second capacitor, and $V_{data}$ is the data voltage required for the driving transistor to operate.

It can be seen by referring to Equations (12)-(14) that the pixel circuit and the timing control method thereof shown in FIGS. 5A, 5B, and 6 can provide, through the driving transistor T3, to the light-emitting element, a driving current that is free of the effect caused by change of the threshold voltage.

By adopting the above pixel circuit and its control timing, the method for determining the output current of the transistor based on the Gaussian disorder jump theory can be used to predict the driving current of the driving transistor outputted to the light emitting element by using a computer simulation approach before the integrated circuit is fabricated. When only the driving transistor is set as the organic thin film transistor, workload of the computer simulation can be simplified.

According to the relationship between the output current and the control voltage of the transistor based on the Gaussian disorder jump theory, the above pixel circuit can provide a driving current that is not affected by change of the threshold voltage of the driving transistor to the light emitting element.

Figure 8:
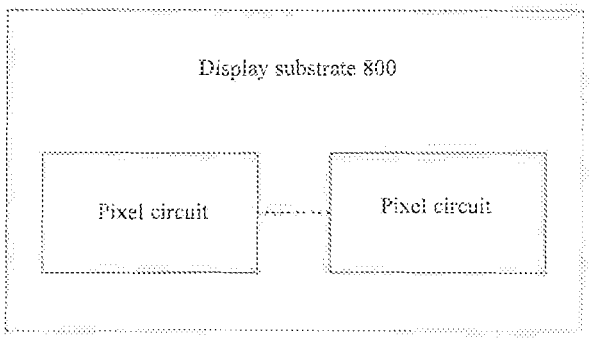
FIG. 8 shows a schematic block diagram of a display substrate according to an embodiment of the present disclosure.

FIG. 8 shows a schematic block diagram of a display substrate according to an embodiment of the present disclosure. As shown in FIG. 8, the display substrate 800 may comprise a plurality of pixel circuits, which may be pixel circuits provided by any of the embodiments of the present disclosure. The plurality of pixel circuits may be arranged in an array, but the embodiments of the present disclosure are not limited thereto.

For example, the display substrate 800 may further comprise a plurality of control signal lines (e.g., gate lines) and a plurality of data lines that are disposed to intersect to each other (e.g., vertically), and a plurality of voltage control lines disposed in parallel with the control signal lines. For example, each pixel circuit is connected to a corresponding control signal line and a corresponding data line. For example, a scanning control terminal of each pixel circuit may be connected to a corresponding scan signal line, and a data voltage terminal of each pixel circuit may be connected to a corresponding data line, and a voltage control terminal of each pixel circuit may be connected to a corresponding voltage control line. For example, in a case where a plurality of pixel circuits are arranged in an array, pixel circuits located in each row of the pixel circuit array may be connected to the same one control signal line, pixel circuits located in each column of the pixel circuit array may be connected to the same one data line. However, the embodiments of the present disclosure are not limited thereto.

With the above display device, the light-emitting element can be supplied with a driving current that is not affected by change of the threshold voltage of the driving transistor.

Figure 9:
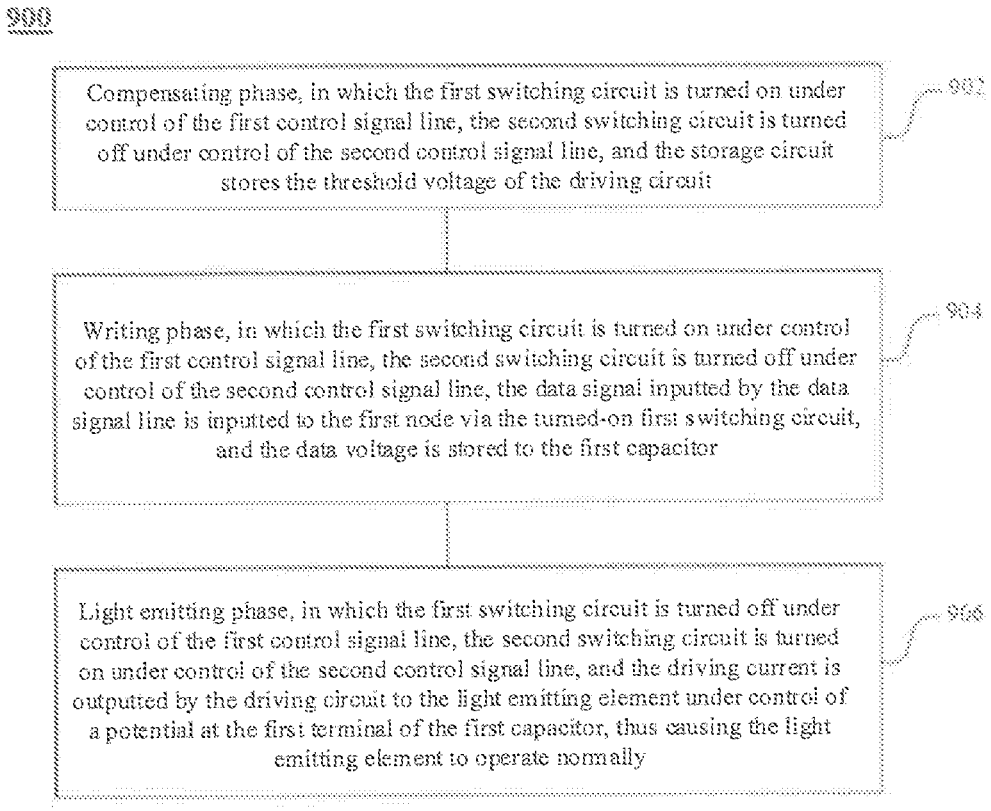
FIG. 9 shows a flowchart of a driving method for a pixel circuit according to an embodiment of the present disclosure.

FIG. 9 shows a flowchart of a driving method for a pixel circuit according to an embodiment of the present disclosure.

In the driving method 900 shown in FIG. 9, step 902 is a compensating phase, in which the first switching circuit is turned on under control of the first control signal line, the second switching circuit is turned off under control of the second control signal, and the storage circuit stores the threshold voltage of the driving sub-circuit.

Step 904 is a writing phase, in which the first switching circuit is turned on under control of the first control signal line, the second switching circuit is turned off under control of the second control signal, the data signal inputted by the data signal line is inputted to the first node via the turned-on first switching circuit, and the data voltage is stored to the first capacitor.

In step 904, storing the data voltage to the first capacitor further comprises: after the second switching circuit is turned off under control of the second control signal, discharging the first capacitor via the driving sub-circuit, and when a voltage difference between the first terminal and the second terminal of the first capacitor decreases to the threshold voltage of the driving sub-circuit, turning off the driving sub-circuit.

Step 906 is a light emitting phase, in which the first switching circuit is turned off under control of the first control signal line, the second switching circuit is turned on under control of the second control signal, and the driving current is outputted by the driving circuit to the light emitting element under control of the potential at the first terminal of the first capacitor, thus causing the light emitting element to operate normally.

By adopting the above pixel circuit and its driving method, the method of determining the output current of the transistor based on the Gaussian disorder jump theory can be used to predict the driving current outputted by the driving transistor to the light emitting element by using a computer simulation approach before the integrated circuit is fabricated. According to the relationship between the output current and the control voltage of the transistor based on the Gaussian disordered jump theory, the driving method of the pixel circuit described above can provide a driving current which is not affected by change of the threshold voltage of the driving transistor to the light emitting element.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The above is illustration of the present disclosure and should not be construed as making limitation thereto. Although some exemplary embodiments of the present disclosure have been described, a person skilled in the art can easily understand that many modifications may be made to these exemplary embodiments without departing from the novel teaching and advantages of the present disclosure. Therefore, all such modifications are intended to be included within the scope of the present disclosure as defined by the appended claims. As will be appreciated, the above is to explain the present disclosure, it should not be constructed as limited to the specific embodiments disclosed, and modifications to the specific embodiments disclosed and other embodiments are included in the scope of the attached claims. The present disclosure is defined by the claims and their equivalents.

What is claimed is:

1. A pixel circuit configured to drive a light emitting element, comprising:

a first switching sub-circuit, wherein a first terminal of the first switching sub-circuit is connected to a data signal line, a second terminal of the first switching sub-circuit is connected to a first control signal line, and a third terminal of the first switching sub-circuit is connected to a first node, and the first switching sub-circuit is configured to input a data signal of the data signal line to the first node under control of the first control signal line;

a second switching sub-circuit, wherein a first terminal of the second switching sub-circuit is connected to a first signal line, a second terminal of the second switching sub-circuit is connected to a second control signal line, and a third terminal of the second switching sub-circuit is connected to a second node;

a driving sub-circuit, wherein a first terminal of the driving sub-circuit is connected to the first node, a second terminal of the driving sub-circuit is connected to the second node, and a third terminal of the driving sub-circuit is connected to an input terminal of the light emitting element, and the driving sub-circuit is configured to drive the light emitting element to emit light under control of a potential at the first node; and a storage sub-circuit, wherein a first terminal of the storage sub-circuit is connected to the first node, and a second terminal of the storage sub-circuit is connected to the second node, the storage sub-circuit is configured to store the threshold voltage of the driving sub-circuit before the second switching sub-circuit is turned on in each working period of the pixel circuit;

wherein the second switching sub-circuit is configured to input a first signal of the first signal line to the second node under control of the second control signal line, and the first switching sub-circuit is configured to discharge the driving sub-circuit under the control of the first control signal line to store the threshold voltage of the driving sub-circuit in the storage sub-circuit.

2. The pixel circuit of claim 1, wherein the storage sub-circuit further comprises:

a first capacitor, wherein a first terminal of the first capacitor is connected to the first node, and a second terminal of the first capacitor is connected to the second node, the first capacitor is configured to store the threshold voltage of the driving sub-circuit before the second switching sub-circuit is turned on in said each working period.

3. The pixel circuit of claim 2, wherein the storage sub-circuit further comprises:

a second capacitor, wherein a first terminal of the second capacitor is connected to the second node, and a second terminal of the second capacitor is connected to a second signal line.

4. The pixel circuit of claim 3, wherein the driving sub-circuit comprises a driving transistor, a first terminal of the driving transistor is connected to the second node, a second terminal of the driving transistor is connected to the input terminal of the light emitting element, and a control terminal of the driving transistor is connected to the first node, and the driving transistor is configured to be turned on under control of the potential at the first node, and to drive the light emitting element to emit light.

5. The pixel circuit of claim 4, wherein when the driving transistor is configured to be turned on under control of the potential at the first node, the driving current outputted by the driving transistor is determined through the following equation:

$$I_{OLED} = \frac{W}{L}\mu(T)C_{ox}V_{ds}\left[\frac{2k_BT}{q} + V_{gs} + V_{fb} + \frac{1}{2}V_{ds}\right]$$

where W is the channel width of the driving transistor, L is the channel length of the driving transistor, μ(T) is the carrier mobility of the driving transistor, $k_s$ is a Boltzmann constant, q is the electric quantity of a unit charge, T is the operating temperature of the driving transistor, $C_{ox}$ is the capacitance per unit area of insulating layer of the transistor, and $V_{fb}$ is the threshold voltage of the driving transistor, and $$V_{gs} = -\left(\frac{C_2}{C_1 + C_2}(V_{ref} - V_{data}) + |V_{fb}|\right)$$

where $V_{ref}$ is the reference voltage, $C_1$ is the capacitance value of the first capacitor, $C_2$ is the capacitance value of the second capacitor, and $V_{data}$ is the data voltage required for the driving transistor to operate.

6. The pixel circuit of claim 4, wherein the first switching sub-circuit comprises a first switching transistor, a first terminal of the first switching transistor is connected to the data signal line, a second terminal of the first switching transistor is connected to the first node, and a control terminal of the first switching transistor is connected to the first control signal line, and the first switching transistor is configured to be turned on under control of the first control signal line, and input the data signal of the data signal line to the first node.

7. The pixel circuit of claim 6, wherein the second switching sub-circuit comprises a second switching transistor, a first terminal of the second switching transistor is connected to the first signal line, a second terminal of the second switching transistor is connected to the second node, and a control terminal of the second switching transistor is connected to the second control signal line, the second switching transistor is configured to be turned on under control of the second control signal line, and to input the first signal of the first signal line to the second node.

8. The pixel circuit of claim 7, wherein the driving transistor is an organic thin film transistor.

9. The pixel circuit of claim 7, wherein the first switching transistor is an organic thin film transistor.

10. The pixel circuit of claim 7, wherein the second switching transistor is an organic thin film transistor.

11. The pixel circuit of claim 1, wherein the light emitting element is an organic light emitting diode.

12. A display substrate, comprising: the pixel circuit of any of claim 1.

13. A method for driving the pixel circuit of claim 7, comprising:

a compensating phase, in which the first switching sub-circuit is turned on under control of the first control signal line, the second switching sub-circuit is turned off under control of the second control signal line, and the storage sub-circuit stores the threshold voltage of the driving circuit;

a writing phase, in which the first switching sub-circuit is turned on under control of the first control signal line, the second switching sub-circuit is turned off under control of the second control signal line, the data signal inputted by the data signal line is inputted to the first node via the turned-on first switching sub-circuit, and the data voltage is stored to the first capacitor; and a light emitting phase, in which the first switching sub-circuit is turned off under control of the first control signal line, the second switching sub-circuit is turned on under control of the second control signal, and the driving current is outputted by the driving sub-circuit to the light emitting element under control of the potential at the first terminal of the first capacitor, thus causing the light emitting element to operate normally.

14. The method for driving of claim 13, wherein during the compensation phase, storing the threshold voltage of the driving sub-circuit by the storage sub-circuit is realized through the following operations:

after the second switching sub-circuit is turned off under control of the second control signal line, discharging the first capacitor via the driving sub-circuit, and when a voltage difference between the first terminal and the second terminal of the first capacitor decreases to the threshold voltage of the driving sub-circuit, turning off the driving sub-circuit.

* * * * *